US005535527A

United States Patent [19]

Virta et al.

[11] Patent Number: 5,535,527

[45] Date of Patent: Jul. 16, 1996

[54] METHOD AND ARRANGEMENT IN A MULTI-CYLINDER DRYER OF A PAPER MACHINE

[75] Inventors: Raimo Virta, Turku; Seppo Rantanen, Merimasku, both of Finland

[73] Assignee: Valmet Corporation, Helsinki, Finland

[21] Appl. No.: 477,427

[22] Filed: Jun. 7, 1995

[51] Int. Cl.[6] ..... F26B 11/02

[52] U.S. Cl. ..... 34/117; 34/447; 34/453; 34/458; 162/193; 162/363; 162/368

[58] Field of Search ..... 34/403, 406, 419, 34/445, 453, 458, 559, 113, 111, 117, 120; 162/192, 193, 368, 370, 363, 372

[56] References Cited

U.S. PATENT DOCUMENTS

| | | | |
|---|---|---|---|
| 2,276,448 | 3/1942 | Allen et al. | 34/445 |
| 3,956,832 | 5/1982 | Justus | 34/116 |
| 4,744,156 | 5/1988 | Futcher | 34/116 |
| 4,905,379 | 3/1990 | Wedel | 34/16 |
| 4,905,380 | 3/1990 | Eskelinen et al. | 34/23 |
| 4,980,979 | 1/1991 | Wedel | 34/23 |
| 5,015,336 | 5/1991 | Roerig et al. | 34/120 |
| 5,022,163 | 6/1991 | Ilvespaa et al. | 34/23 |
| 5,031,338 | 7/1991 | Wedel | 345/115 |
| 5,044,095 | 9/1991 | Eivola | 34/117 |
| 5,062,216 | 11/1991 | Hannigan | 34/453 |
| 5,068,980 | 12/1991 | Müller | 34/116 |
| 5,074,278 | 12/1991 | Turcotte | 34/116 |
| 5,152,078 | 10/1992 | Wedel | 34/115 |
| 5,241,760 | 9/1993 | Wedel | 34/115 |
| 5,331,749 | 7/1994 | Thiele | 34/120 |
| 5,377,428 | 1/1995 | Clark | 34/116 |

FOREIGN PATENT DOCUMENTS

| | | |
|---|---|---|
| 0617162 | 9/1994 | European Pat. Off. . |
| 80491 | 3/1989 | Finland . |
| 83680 | 9/1989 | Finland . |

OTHER PUBLICATIONS

"Operating Results With the Bel-Champ Single-Tier Dryer", TAPPI Proceedings, 1990 Enginering Conference, pp. 393–398.

*Primary Examiner*—John M. Sollecito
*Assistant Examiner*—Steve Gravin
*Attorney, Agent, or Firm*—Steinberg, Raskin & Davidson

[57] ABSTRACT

A method for causing adherence of a web to a drying wire so as to prevent the effects of centrifugal forces and of other air-flow phenomena, which effects attempt to separate the web from the drying wire in dryer groups having a single-wire draw and arranged in a multi-cylinder dryer of a paper machine. The dryer groups include heated drying cylinders, a drying wire for pressing the web against outer cylinder faces of the drying cylinders, and guide cylinders or rolls on which the web runs on the outside face of the drying wire. The guide cylinders have perforations which pass through the cylinder mantle and open into an inside space in the interior of the guide cylinders which is subjected to a vacuum. The vacuum in the guide cylinders is transferred to the outside face through the perforations. The guide cylinders have shafts on which the guide cylinders are mounted revolving. The vacuum level in the guide cylinders is regulated by means of the air quantity in compliance with the threading/running stage and/or running speed and/or with any other process or running parameter of the dryer section of the paper machine so that the effect of the vacuum is sufficient to keep the web in reliable contact with the drying wire.

30 Claims, 1 Drawing Sheet

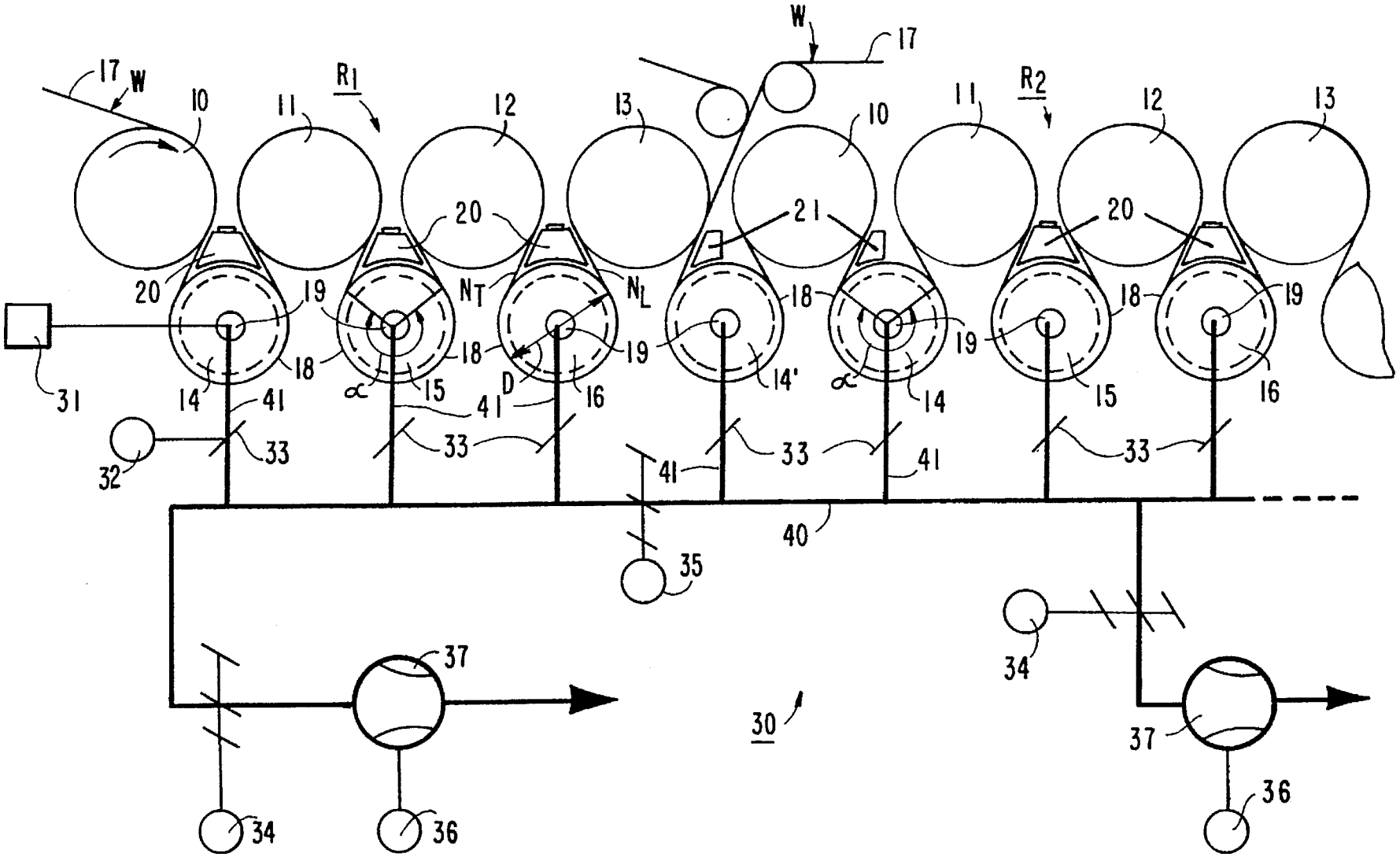
R1
R2
W
W
NL
NT
D
α
α
10
11
12
13
14
14'
15
16
17
18
19
20
21
30
31
32
33
34
35
36
37
40
41

METHOD AND ARRANGEMENT IN A MULTI-CYLINDER DRYER OF A PAPER MACHINE

BACKGROUND OF THE INVENTION

The present invention relates to a method and arrangement for making a web adhere to a drying wire in dryer groups provided with single-wire draw in a multi-cylinder dryer of a dryer section of the paper machine so as to prevent or at least substantially curtail the effects of centrifugal forces and other air-flow phenomena which attempt to separate the web from the drying wire in the dryer groups. The dryer groups comprise drying cylinders which are heated by means of steam or equivalent, and the web is pressed therein against outer, heated cylinder faces of the drying cylinders by means of the drying wire. The dryer groups further comprise guide cylinders or rolls on which the web runs on the outside face of the drying wire. The guide cylinders or rolls are provided with perforations which pass through the cylinder mantle and open into the inside space in the interior of the guide cylinder or roll, the inside space being subjected to a vacuum. The vacuum in the guide cylinders or rolls is transferred to the outside face of the drying wire through the perforations, and the guide cylinders or rolls comprise shafts on which the guide cylinders or rolls are revolvingly mounted.

In the prior art, multi-cylinder dryers of paper machines usually consist of two horizontal rows of drying cylinders placed one row above the other whereby a paper web runs a meandering course between the rows. At present, in connection with the drying cylinders, drying wires penetrable by air are used, i.e. permeable drying wires.

In the dryer section of a paper machine, single-wire draw and/or twin-wire draw is/are employed. Single-wire draw refers to a draw in which the web runs from one drying cylinder onto another cylinder, which are typically in two different rows, on support of one and the same drying wire as well as on support thereof across the gaps between the rows of cylinders. In twin-wire draw, an upper wire and a lower wire are employed to press the web against heated cylinder faces of drying cylinders in an upper row and a lower row, respectively, and the web has free, unsupported draws when it runs from one row of drying cylinders to the other.

The present invention is primarily related to a single-wire draw dryer group in which the web runs from one row of cylinders to the other on support of the same drying wire so that, on one row of cylinders, the web is situated between the drying wire and the cylinder face and, on the other row of cylinders, the web is situated farthest from the cylinder, the drying wire being situated between the cylinder face and the web, and the web runs over the draws between the rows of cylinders on support of the drying wire. It is an advantage of this single-wire draw that the web is constantly supported by the drying wire, and has no free draws, whereby the risk of wrinkles in and breaks of the web are reduced.

In prior art multi-cylinder dryers that apply single-wire draw, on the cylinders on which the web to be dried is placed outside or farthest from the cylinder, which are conventionally leading rolls or cylinders, a drawback is a tendency of separation of the web from the face of the drying wire by the effect of centrifugal force, which phenomenon is intensified further by the pressures induced in the inlet nip between the drying wire and the cylinder faces. This separation already produces breaks or at least bag formation and wrinkles in the web.

At the reversing rolls in these groups with single-wire draw in the dryer section of a paper machine, a problem is the adhering of the paper web to the wire on the lower face of the cylinder. On the lower cylinders, i.e., the reversing rolls, the web runs topmost, i.e., the farthest from the cylinder faces, while the wire remains between the web and the outer face of the cylinder. In the case of the other rolls in a group with single-wire draw, this problem does not occur since the paper web runs between the wire and the mantle face of the cylinder.

Attempts have been made to solve this problem by using suction rolls in which there are separate suction sectors in the interior. A suction-roll solution is, however, expensive and requires servicing. A more favorable solution is described in the assignee's Finnish Patent No. 83,680 (corresponding to U.S. Pat. No. 5,022,163), in which a cylinder for a paper machine is described which is particularly suitable for use for supporting the web in connection with the lower rolls in a single-wire group. This cylinder is mainly characterized in that the grooved cylinder includes numerous holes which pass through the mantle and one of whose ends open in the grooves and the other end into the interior space in the cylinder. This grooved roll is provided with drilled suction holes passing through the roll mantle to the bottom of the grooves in the roll, and one end or both ends of the roll is/are provided with a shaft which comprises a suction duct, which communicates further with a source of suction. When the holes are dimensioned suitably and when the roll mantle is provided with a certain limited number of bores that transfer the vacuum (negative pressure or suction force), a permanent vacuum is provided in the interior of the roll. This vacuum can be maintained in spite of the fact that some of the holes in the roll are opened into the open air in the top portion of the roll. The effect of the vacuum spreads in the groove. In this manner, a simple roll solution has been provided in which, by means of the vacuum, the web is pulled toward the roll and the suction is applied to the web through the wire.

With respect to other prior art related to the present invention, reference is made to European Patent Application No. 94 200 656 (EP 0 617 162), which claims the priority of Finnish Patent Application No. 881106 which in turn corresponds to the above-mentioned Finnish Patent, and was separated from the European patent application corresponding to above-mentioned Finnish Patent by splitting. In the separated EP application, a method is suggested for making the web adhere to the drying wire so as to prevent the effects of centrifugal forces and other air-flow phenomena, which effects attempt to separate the web from the wire in dryer groups that are provided with single-wire draw in a multi-cylinder dryer of a paper machine. The dryer groups comprise drying cylinders as the upper cylinders, which drying cylinders are heated with steam or equivalent, and the web is pressed against the outer cylinder face of the drying cylinders by means of a drying wire. Further, the dryer groups comprise guide cylinders or rolls as the lower cylinders, on which cylinders the web runs outside the drying wire. The lower cylinders are provided with holes which pass through the cylinder mantle and open into the space in the interior of the cylinder in which a vacuum is present. The vacuum or suction force is transferred to the outside face of the lower cylinders through the holes. The lower cylinders comprise shafts on which the cylinders are revolvingly mounted and at least one of the shafts is provided with a duct through which the vacuum is produced in the interior space in the cylinder. The shafts are connected to a suction duct which communicates with a source of vacuum. In that invention, one of the novel aspects is that a major part of the holes in the cylinder are open toward the open air (atmosphere) in the top portion of the cylinder so that the air flow is directed toward the interior of the cylinders. Another aspect is that the vacuum inside the cylinder is in the range of about 1000 Pa to about 3000 Pa and is maintained substantially constant.

It has been a problem in the prior art suction rolls that, in spite of the large amount of air, the vacuum in the rolls has not always been adequate to hold the web during tail threading because of the open perforated face. On the other hand, a web of full width does not necessarily require an equally high vacuum and amount of air as the narrow leader strip does because, when a paper web of full width is transferred, the suction roll operates with a smaller amount of air. Thus, it is an important object of the present invention to suggest a solution to this problem, i.e., to provide a variable arrangement which adjusts the amount of suction depending on the requirements of the situation, e.g., threading stage or the running stage. As a solution for this problem, suction rolls have been suggested in which a separate tail threading zone is employed inside the roll in order to apply an adequate suction effect to the leader strip. In this connection, with respect to the prior art, reference should be made, e.g., to U.S. Pat. Nos. 5,031,338, 4,980,979, 4,905,379, 5,152,078 and 5,015,336. Problems of these rolls have involved their complex construction and high cost as well as abundant requirement of servicing, for example, in order to ensure the operation of the valve inside the roll.

By means of the vacuum employed in the reversing cylinders, it is also possible to affect the shrinkage of the web in the dryer section. In this respect, reference is made to the U.S. Pat. No. 5,241,760, in which it is stated that, owing to the longitudinal shrinkage of the paper web, the web is tensioned in the dryer section and thereby transverse shrinkage of the web is already inhibited on the grooved rolls. Regarding the prior art related to this, reference is also made to the paper Pulkowski et al, "Operating results with the bel-champ single-tier dryer", TAPPI Proceedings, 1990 Engineering Conference, pages 393–398. In this paper, it is stated that, based on test results, it has been found that forced drying provides the advantages of increased modulus of elasticity and strength properties and reduced stretch.

In relation to the effects of shrinkage of the web during drying, it can also be stated that the assignee has carried out tests with production machines, which tests have indicated that a fully single-wire draw of the Sym-Run™ type lowers the transverse shrinkage to about one half (e.g., from about 3% to about 1.5%). In the test, when the suction was eliminated from all the suction rolls, the transverse shrinkage was changed from about 1.5% to about 1.8%, i.e., under these circumstances, it can be stated that the effect of the single-wire draw on the change was in this case about 75% to about 80%, and the effect of the suction rolls about 20% to about 25%.

Adherence of the web to the wire on the outer faces of the reversing cylinders or equivalent is also affected by the running speed employed in the dryer section of the paper machine and, of course, by the nature of the paper web that is being run. In such a situation, a constant vacuum in the reversing rolls has not always been suitable in view of holding the web and in view of the shrinkage of the web during drying. For example, it has been noticed that an excessive inhibition of transverse shrinkage of the web has a detrimental effect on the transverse stretch potential of the paper. In some cases, this has even resulted in tearing of the web in the final portion of the dryer section.

OBJECTS AND SUMMARY OF THE INVENTION

It is an important object of the present invention to provide an arrangement in which the vacuum level in the reversing cylinders, for example suction rolls, is suitably adjustable in the dryer section at different stages of running, e.g., threading or full running, at different running speeds, and for different paper grades.

It is a further object of the invention to provide economies of energy, in particular of electrical energy, in the dryer section of the paper machine.

It is another object of the present invention to suggest a solution for the problem of the excessive inhibition of transverse shrinkage of the web having a detrimental effect on the transverse stretch potential of the paper possibly resulting in tearing of the web in the final portion of the dryer section.

In view of achieving the objects stated above and others, in the system in accordance with the present invention, the vacuum level in the guide cylinders or rolls is regulated, by means of the air quantity flowing from the interior of the cylinders or rolls, in compliance with the required vacuum level which depends on the threading stage, the running stage and/or the running speed and/or with any other process or running parameter of the dryer section of the paper machine so that the effect of the vacuum is sufficient to keep the web in reliable contact with the drying wire.

According to the invention, a vacuum of maximal efficiency is produced in the suction roll for the time of threading because the pressure level in the suction roll is regulated by means of the air quantity during running/threading. Since an equally large quantity of air and an equally high vacuum are not necessarily needed with a web of full width, in the suction roll it is possible to use a smaller amount of air during running operation and to increase the air quantity for the time of threading. This is arranged in accordance with the invention by regulating the pressure level automatically by controlling the operation of regulation devices described below which operate to vary the pressure in the suction rolls. According to the invention, both situations can be given their own pressure value settings, or it can be simply arranged so that, in the threading position, full air flow is available, and the pressure level of the running position is regulated automatically. Moreover, according to the invention, the extent of suction at different locations of the cylinder face can be varied, for example, by using different numbers of holes in the face of the suction roll.

In another embodiment of the invention, the vacuum level in the suction roll is regulated, first in accordance with the running stage of the paper machine, then also in accordance with the running speed to be used and, of course, also in accordance with the paper grade to be run. In this manner, in the invention, the accordance with the requirements.

In the arrangement in accordance with the invention, the measurement of the vacuum in the reversing cylinder, in particular in a suction roll, is carried out from the interior of the roll, and the regulation of the vacuum can be carried out, among other things, by varying the speed of rotation of the blower which removes the air thus creating the vacuum, by limiting the overall air flow, by varying the air flow from each particular roll, or, if several suction blowers are in use, in a joint system of ducts it is possible, for example, to stop some of the blowers completely. The vacuum level in the roll can also be varied by regulating the capacity of outside blow/suction boxes that cover the whole free roll face (See, e.g., the assignee's Finnish Patent No. 80,491, corresponding to U.S. Pat. No. 4,905,380, the specification of which is hereby incorporated by reference herein), without suction in the roll or together with suction in the roll. The invention is not confined to the use of a blow box of this type alone. The change in the vacuum can be carried out immediately after the stage of spreading the web or after a certain time interval. In the threading situation, the highest possible flow is regulated for the blower, and after the spreading stage, the change in vacuum can be carried out by means of vacuum measurement from the suction roll or by restricting the flow of air from the suction roll on the basis of experimental data so that the pre-determined pressure level is produced in the interior of the roll.

In the arrangement in accordance with the invention, the vacuum in the reversing cylinders, in particular in suction rolls, can be regulated either individually each suction roll for itself, or appropriately also so that the vacuum levels in the suction rolls in the different dryer groups are regulated to be suitable in relation to the other dryer groups. Also, the vacuum level in the guide cylinders can be regulated when the dry solids content of the paper web increases in the machine direction.

Further, the level of suction applied in the drying cylinders in the initial end of the drying section may be regulated according to the dry solids content of the web thereat.

Briefly, in the arrangement for regulating adherence of a web to a drying wire in a dryer group provided with single-wire draw in a multi-cylinder dryer of a paper machine, the dryer group comprises heated drying cylinders, guide cylinders having a perforated mantle and an interior space which is subjected to a vacuum, and a drying wire for pressing the web against outer cylinder faces of the drying cylinders and for carrying the web over the guide cylinders such that the drying wire is situated between the outer cylinder faces and the web. A main air flow line and a component air flow line leading from the main air flow line to each of the guide cylinders are provided. Air flow regulation means are coupled to at least one of the main air flow line and each of the component air flow lines. The regulation means regulate the level of the vacuum in each of the guide cylinders such that the vacuum level is adjustable relative to a process or running parameter of the dryer section of the paper machine. In one embodiment, the vacuum level existing in at least one of the guide cylinders can be measured by measurement means and the vacuum level in the guide cylinders regulated on the basis of the measured vacuum level.

The suction roll used in the invention may be a grooved suction roll marketed by the assignee under the trade name VAC-roll and which does not include a separate suction zone inside the roll. In this regard, reference is made to U.S. Pat. No. 5,022,163 described above.

In the following, the invention will be described in detail with reference to a preferred exemplifying embodiment of the invention illustrated in the figure in the accompanying drawing. However, the invention is by no means strictly confined to the details of the illustrated embodiment alone.

BRIEF DESCRIPTION OF THE DRAWINGS

The following drawing is illustrative of a preferred embodiment of the invention and is not meant to limit the scope of the invention as encompassed by the claims.

The figure is a schematic illustration of a part of a dryer section of a paper machine in accordance with the invention.

DETAILED DESCRIPTION OF THE INVENTION

As shown in the figure, dryer groups $R_1$,$R_2$ comprise a substantially horizontal row of steam-heated drying cylinders 10,11,12 and 13. Drying wires 17 guides a paper web W on an outer face thereof through a respective one of the dryer groups and presses the web against heated outer faces of the cylinders 10,11,12 and 13 in that group so that an evaporation-drying effect is produced. Underneath the row of drying cylinders 10,11,12,13, there are non-heated reversing cylinders 14', 14, 15 and 16 or equivalent guide rolls arranged in a substantially horizontal row, which preferably have suction sectors a or equivalent arrangements which produce a suction effect so that the web W remains reliably on the outer face of the drying wire 17 even at high web running speeds.

The group $R_1$ of drying cylinders shown in the figure is, for example, the first dryer group in the dryer section of the paper machine, and the web W is brought onto the drying wire 17 from the press section (not shown). After the dryer groups $R_1$,$R_2$, the dryer section includes one or more dryer groups with single-wire draw similar to those shown in the figure or inverted dryer groups with single-wire draw. In inverted groups, the drying cylinders are situated in the lower row and the guide rolls or cylinders are situated in the upper row above the drying cylinders. In addition to the groups with single-wire draw mentioned above, the dryer section may also include one or several groups with twin-wire draw, a description of which is set forth above.

Each of the lower cylinders 14',14,15 and 16 is provided with a mantle 18 having perforations extending at least over the area over which the web W extends in the cross direction of the machine, that is the direction transverse to the running direction of the web. A vacuum (also commonly referred to in the art as negative pressure or suction) is introduced into an interior space in each of the cylinders 14',14,15,16 through a duct formed in a shaft 19 of each of the cylinders 14',14,15,16, i.e., air is removed from the interior to provide the suction effect. The cylinders 14',14,15,16 are mounted to revolve via shafts 19 which are fixed to the frame of the dryer section (not shown).

Blow boxes 21 are employed in the dryer groups $R_1$,$R_2$ and are arranged in gaps between adjacent cylinders 10,11, 12, etc. By means of the blow boxes 21, it is ensured that the web remains in contact with the wire at its inlet side.

It is also possible to employ combined blow-suction boxes 20 or equivalent (such as standard suction boxes without a blowing element) which are arranged in gaps between the cylinders 10,11,12, etc. By means the combined blow-suction boxes 20, upper free sectors of the reversing cylinders 14', 14, etc., i.e., those sectors over which the drying wire does not run, are covered as completely as is permitted by the safety clearances. The blowings from the blow-suction boxes 20 affect the level of the vacuum present in the interior spaces of the guide cylinders.

In a blow box 21 or suction-blow box 20, there is often a pressure compartment in which a pressure p+ is present. By means of the pressure compartment, ejection blowings are produced and operate to eject fields of vacuum into the gap spaces in connection with the walls of the box 20,21. By means of these fields of vacuum present in the spaces, it is ensured at the inlet side or at the inlet and outlet side of the drying wire 17 that, on the straight runs of the web W, the web W remains reliably on the face of the drying wire 17. These fields of vacuum also make sure, for their part, that in an inlet nip NT and in an outlet nip $N_L$ between the drying wire 17 and the lower cylinder 14',14, etc., there is a sufficiently low pressure level in order to keep the web W reliably on the outer face of the wire 17.

In the interior of the suction and blow box 20, a suction compartment is also provided which opens on the free sector of the lower cylinder or roll 14 between the nips $N_T$ and $N_L$. This suction compartment is subjected to a vacuum which is applied through the perforations in the mantle 18 of the lower cylinder to the interior of the lower cylinder. Thus, on the sector a of the cylinders 14, on which the web W is placed at the side of the outside curve, when the vacuum acts upon the web W through the relatively permeable drying wire 17, the vacuum has the effect that the web W remains in reliable contact on the outer face of the drying wire 17 even at high speeds and even with a small curve radii $D_{1/2}$.

The measurement of the vacuum of the reversing cylinder 14', 14, etc or suction roll in the lower roll is carried out from the interior space of the roll by a measurement device 31. Measurement device 31 measures the vacuum in the interior of the reversing cylinder 14 in the dryer group $R_1$. Of course, such a measurement arrangement can also be placed in connection with other reversing cylinders. The measurement device can also be placed in the system of ducts outside the roll when the vacuum in the roll can be established reliably from the measurement result empirically or by appropriate computations.

The regulation of the vacuum in the reversing cylinders 14,14', 15,16 is carried out, for example, by means of a regulation system 30 including a regulation device 36 which functions to change the speed of rotation of a blower 37 which in turn controls the amount of air being removed from the reversing rolls 14,14',15 and 16 through respective shafts 19 to thus regulate the vacuum force. Alternatively, the regulation system may function to restrict the overall air flow circulating by controlling the regulation devices 34. It is also possible to regulate the vacuum specifically for each roll, e.g., by means of the regulation device 32, by regulating the air flow from each roll 14',14, 15,16 by means of a regulating damper 33 situated in a flow line 41 of air between the reversing cylinders and a main outflow line 40. If the system includes several air blowers 37 in the same system of ducts in the system 30, if necessary, based on the control by the regulation device 36, it is possible to switch off some of the air blowers 37. Also, it is possible to regulate the vacuum level in the guide cylinders by adjusting blade wings of the blowers 37 at varying angles of operation. Additionally, it is possible to regulate the vacuum level in different groups of guide cylinders by adjusting dampers connected to regulation device 35 which are positioned in the main flow line 40 separating the groups.

Generally, the blowers 37 are switched off to reduce the amount of air being drawn from the interior spaces of the guide cylinders 14, 14', 15,16 to reduce the vacuum level therein and are switched on to increase the amount of air being drawn from the interior spaces of the guide cylinders 14,14',15,16 to increase the vacuum level therein.

The vacuum level in the reversing cylinders or suction rolls 14',14, etc. can also be regulated by changing the capacity of the outside blow/suction box 20, either while jointly regulating the suction of the roll or without suction of the roll. Furthermore, the vacuum level in the reversing cylinders can be regulated by the suction blower such that the speed of rotation of the suction blower and the amount of air being drawn by the suction blower are varied by inverter operation.

In operation, for threading of the web, the roll suction in the reversing cylinders 14',14, etc. is regulated to an efficient vacuum value, after which the vacuum can be reduced after the web spreading stage either, for example, at once or after a certain time interval of between 0 and 60 seconds, preferably after 0 to 20 seconds. Thus, the vacuum level in the guide cylinders can be regulated to provide a different vacuum level for a threading stage of the dryer and a running stage of the dryer.

After the web threading has been completed and the spreading stage is over, the vacuum level is changed, e.g., based on roll-internal vacuum measurement or by restricting the air flow from the suction roll based on experimental data, so that a predetermined pressure level is obtained for the roll interior. During running of the web, the vacuum level is from about 500 Pa to about 3000 Pa, preferably from about 600 Pa to about 2000 Pa.

The figure shows the system 30 of the invention in combination with two groups $R_1$ and $R_2$ of drying cylinders in the dryer section. Of course, a multi-cylinder dryer section of a paper machine may include one or several such dryer groups provided with a system 30 for vacuum regulation.

The examples provided above are not meant to be exclusive. Many other variations of the present invention would be obvious to those skilled in the art, and are contemplated to be within the scope of the appended claims.

We claim:

1. A method for regulating adherence of a web to a drying wire in a dryer group provided with single-wire draw in a multi-cylinder dryer of a paper machine, the dryer group comprising heated drying cylinders, guide cylinders having a perforated mantle and an interior space which is subjected to a vacuum, and a drying wire for pressing the web against outer cylinder faces of the drying cylinders and for carrying the web over the guide cylinders such that the drying wire is situated between the outer cylinder faces and the web, the method comprising the steps of:

arranging a single suction zone in the interior space of each of said guide cylinders extending substantially across the entire width of said guide cylinders, and regulating the level of the vacuum in the suction zone in the interior space of said guide cylinders during running of the web through the dryer group as a function of a process or running parameter of the dryer of the paper machine to thereby keep the web in reliable contact with the drying wire in different running conditions.

2. The method of claim 1, wherein the vacuum level is regulated to provide a different vacuum level in at least one of said guide cylinders for a threading stage of the dryer and a running stage of the dryer.

3. The method of claim 1, wherein the vacuum level is regulated as a function of the running speed of the web through the dryer.

4. The method of claim 1, further comprising the steps of:

revolvingly mounting said guide cylinders on shafts, generating the vacuum in the interior space in said guide cylinders through a duct in said shafts, and connecting said shaft with a vacuum source.

5. The method of claim 1, further comprising the steps of:

arranging combined blow-suction boxes in gaps between adjacent ones of said drying cylinders to substantially cover upper free sectors of said guide cylinders over which said drying wire does not run, and blowing air from said blow-suction boxes to cause the web to adhere to said drying wire before and after it runs over said guide cylinders.

6. The method of claim 1, further comprising the steps of:

connecting the interior space of said guide cylinders in the dryer group with a main flow line, drawing air through said main flow line and thus the interior spaces of said guide cylinders by rotating a suction blower in said main flow line, and varying the speed of rotation of said suction blower to regulate the vacuum level in said guide cylinders.

7. The method of claim 1, further comprising the steps of:

connecting the interior space of said guide cylinders in the dryer group with a main flow line, drawing air through said main flow line and thus the interior spaces of said guide cylinders, and restricting the overall air flow through said main flow line to regulate the vacuum level in said guide cylinders.

8. The method of claim 4, wherein the vacuum level in said guide cylinders is regulated by varying the flow of air that is drawn out of the interior space of said guide cylinders through said ducts formed in said shafts.

9. The method of claim 1, further comprising the steps of:

connecting the interior space of said guide cylinders in the dryer group with a main flow line, drawing air from the interior spaces of said guide cylinders through said main flow line, and switching on/off blowers connected to said main flow line to regulate the vacuum level in said guide cylinders, said blowers being switched off to reduce the amount of air being drawn from the interior spaces of said guide cylinders to reduce the vacuum level in said guide cylinders and being switched on to increase the amount of air being drawn from the interior spaces of said guide cylinders to increase the vacuum level in said guide cylinders.

10. The method of claim 1, further comprising the steps of:

connecting the interior space of said guide cylinders in the dryer group with a main flow line, drawing air through said main flow line and thus the interior spaces of said guide cylinders by rotating a suction blower in the main flow line, and adjusting blade wings of said blower to regulate the vacuum level in said guide cylinders.

11. The method of claim 1, further comprising the steps of:

measuring the vacuum level existing in at least one of said guide cylinders, and regulating the vacuum level in said guide cylinders on the basis of the measured vacuum level.

12. The method of claim 1, wherein the vacuum level in said guide cylinders is regulated in accordance with predetermined values.

13. The method of claim 1, wherein the vacuum level in said guide cylinders is regulated in accordance with the grade of paper that is being dried in the dryer.

14. The method of claim 1, further comprising the step of independently regulating the vacuum level in each of said guide cylinders in the dryer group.

15. The method of claim 1, further comprising the step of controlling the vacuum level in said guide cylinders in a range of from about 600 Pa to about 2000 Pa for the time of running operation of the paper machine.

16. The method of claim 1, wherein the method is applied in a multi-cylinder dryer of a paper machine over substantially the entire length of the dryer.

17. The method of claim 1, wherein the vacuum level in the guide cylinders is regulated when the dry solids content of the paper web increases in the machine direction.

18. The method of claim 1, wherein the level of the vacuum in the interior space of each of first and second ones of said guide cylinders is regulated independent of the vacuum level in the other of said first and second guide cylinders.

19. The method of claim 1, further comprising the step of regulating the level of the vacuum applied in the drying cylinders in an initial end of the drying section according to the dry solids content of the web thereat.

20. An arrangement for regulating adherence of a web to a drying wire in a dryer group provided with single-wire draw in a multi-cylinder dryer of a paper machine, the dryer group comprising heated drying cylinders, guide cylinders having a perforated mantle and an interior space which is subjected to a vacuum, and a drying wire for pressing the web against outer cylinder faces of the drying cylinders and for carrying the web over the guide cylinders such that the drying wire is situated between the outer cylinder faces and the web, the arrangement comprising a main air flow line, component air flow lines, each leading from said main air flow line to a respective one of said guide cylinders, and air flow regulation means coupled to said component air flow lines and/or to said main air flow line, the interior space of each of said guide cylinders including a single suction zone extending substantially across the entire width of said guide cylinders, said regulation means regulating the level of the vacuum in the suction zone in the interior space of said guide cylinders during running of the web through the dryer group as a function of a process or running parameter of the dryer of the paper machine.

21. The arrangement of claim 20, wherein said guide cylinders each comprise a shaft fixed to a frame of the paper machine for revolvingly mounting said guide cylinder, said component air flow lines being directed through a respective one of said shafts.

22. The arrangement of claim 20, wherein said regulation means comprise combined blow-suction boxes arranged in gaps between adjacent ones of said drying cylinders to substantially cover upper free sectors of said guide cylinders over which the drying wire does not run, said blow-suction boxes comprising means for blowing air against said guide cylinders.

23. The arrangement of claim 20, wherein said regulation means comprise a suction blower situated in said main flow line, the speed of rotation of said suction blower being varied to regulate the vacuum level in said guide cylinders.

24. The arrangement of claim 20, wherein said regulation means comprise a regulation damper arranged in each of said component flow lines.

25. The arrangement of claim 20, wherein said regulation means independently regulate the vacuum level in each of said guide cylinders relative to other of said guide cylinders.

26. The arrangement of claim 20, wherein said regulation means comprise a suction blower situated in said main flow line, said suction blower having adjustable blades.

27. The arrangement of claim 20, wherein said regulation means comprise a suction blower situated in said main flow line, the speed of rotation of said suction blower and the amount of air being drawn by said suction blower being varied by inverter operation to regulate the vacuum level in said guide cylinders.

28. A method for regulating adherence of a web to a drying wire in a dryer group provided with single-wire draw in a multicylinder dryer of a paper machine, the dryer group comprising heated drying cylinders, guide cylinders having a perforated mantle and an interior space which is subjected to a vacuum, and a drying wire for pressing the web against outer cylinder faces of the drying cylinders and for carrying the web over the guide cylinders such that the drying wire is situated between the outer cylinder faces and the web, the method comprising the step of:

regulating the level of the vacuum in the interior space of said guide cylinders during running of the web through the dryer group as a function of the running speed of the web through the dryer to thereby keep the web in reliable contact with the drying wire in different running conditions.

29. A method for regulating adherence of a web to a drying wire in a dryer group provided with single-wire draw in a multi-cylinder dryer of a paper machine, the dryer group comprising heated drying cylinders, guide cylinders having a perforated mantle and an interior space which is subjected to a vacuum, and a drying wire for pressing the web against outer cylinder faces of the drying cylinders and for carrying the web over the guide cylinders such that the drying wire is situated between the outer cylinder faces and the web, the method comprising the step of:

regulating the level of the vacuum in the interior space of said guide cylinders during running of the web through the dryer group in accordance with the grade of paper that is being dried in the dryer to thereby keep the web in reliable contact with the drying wire in different running conditions.

30. A method for regulating adherence of a web to a drying wire in a dryer group provided with single-wire draw in a multi-cylinder dryer of a paper machine, the dryer group comprising heated drying cylinders, guide cylinders having a perforated mantle and an interior space which is subjected to a vacuum, and a drying wire for pressing the web against outer cylinder faces of the drying cylinders and for carrying the web over the guide cylinders such that the drying wire is situated between the outer cylinder faces and the web, the method comprising the step of:

regulating the level of the vacuum in the interior space of said guide cylinders during running of the web through the dryer group relative to a variation in the dry solids content of the web between different locations in the machine direction as it is dried in the dryer to thereby keep the web in reliable contact with the drying wire in different running conditions.

* * * * *